United States Patent [19]

Buzzard

[11] 4,244,127

[45] Jan. 13, 1981

[54] INTERCONNECTABLE PICTURE FRAMES

[76] Inventor: George Buzzard, Rte. No. 1, Box 474, Houghton Lake, Mich. 48629

[21] Appl. No.: 928,054

[22] Filed: Aug. 14, 1978

[51] Int. Cl.[3] ..... G09F 1/12

[52] U.S. Cl. ..... 40/152.1; 40/617

[58] Field of Search ..... 40/152, 152.1, 607, 40/617, 156, 154; 403/209, 213; 248/489

[56] References Cited

U.S. PATENT DOCUMENTS

| | | | |
|---|---|---|---|
| 374,645 | 12/1887 | Watkins | 40/156 |
| 485,229 | 11/1892 | Reed | 40/617 |
| 1,904,318 | 4/1933 | Lehere | 40/154 |
| 2,749,636 | 6/1956 | Viglietta | 40/152 |
| 2,837,851 | 6/1958 | Wiklund | 40/152 |
| 3,231,995 | 2/1966 | Anthony | 40/617 |
| 3,673,723 | 7/1972 | Lazar et al. | 40/617 |
| 3,673,724 | 7/1972 | Bell et al. | 40/152 |
| 3,716,288 | 2/1973 | Kannenberg | 40/607 |

FOREIGN PATENT DOCUMENTS

| | | | |
|---|---|---|---|
| 316256 | 11/1919 | Fed. Rep. of Germany | 403/213 |

*Primary Examiner*—Gene Mancene
*Assistant Examiner*—Wenceslao J. Contreras
*Attorney, Agent, or Firm*—Michael L. Bauchan

[57] ABSTRACT

Apparatus for the display of pictures. Both front and back sides of pictures are displayed. The apparatus includes a picture frame having a hook and a loop extending in opposite directions from a ring in which the picture is mounted and retained by tabs. The ring, hook, and loop are substantially in the same plane. A chain of identical frames can be made by connecting the hook of each frame in the loop of the preceding frame. The hook and loop of each frame are substantially at right angles to each other so each frame in the chain is substantially at right angles to each adjoining frame. The fronts of each frame form a spiral and face in a direction different from the direction faced by fronts of adjoining frames.

4 Claims, 5 Drawing Figures

INTERCONNECTABLE PICTURE FRAMES

BACKGROUND OF THE INVENTION

Numerous picture frames are in common use. Usually such frames provide for the display of a single picture.

Some picture frames have been devised which are interconnectable. For example, Lazar et al U.S. Pat. No. 3,673,723 is the U.S. patent issued July 4, 1972 which features interconnected hanging picture frames for each picture has a separate frame and the frames are so designed at the top and bottom that they may be connected to form a chain of indefinite length. The picture frames of Lazar are specifically designed so each picture contained in the picture frame chain is displayed in the same direction. In addition, the picture frame of Lazar is designed to be attached to a wall with the back of each picture facing the wall.

Various other connected picture frames have been developed, including U.S. Pat. Nos. Spertus 3,529,374 and Elrod 3,676,942, both United States patents, and Rodgers et al, British Pat. No. 21,788 issued Jan. 2, 1913.

Each of the preceeding patents pertain to picture frames in which pictures on display all face substantially the same direction and each frame has provided for the display of a single picture.

Since pictures are flat objects having substantially two dimensions it is apparent that they may be displayed by placing the backs of the pictures against each other and mounting them in a single frame so one of the pictures can be viewed from the front of the frame and the other picture can be viewed from the back of the frame. However, such a frame cannot be mounted against a wall in the usual manner as such a mounting only permits viewing the front of the frame.

In recent years there has been an increase in popularity of hanging objects in buildings from room ceilings and from supports attached to room walls so as to extend a substantial distance from the wall.

It is therefore an object of this invention to provide a picture frame in which pictures may be mounted for viewing both the front and back of the picture without moving the picture frame.

It is another object of this invention to provide a picture frame which may be interconnected with identical picture frames to form a chain in which each succeeding picture frame is substantially at 90° to each adjoining picture frame.

It is another object of this invention to provide a picture frame which is of substantially uniform thickness to facilitate manufacture yet is capable of being interconnected with other identical picture frames so that each frame is substantially at 90° with the adjacent frames and which is capable of displaying both front and rear sides of a picture.

The foregoing and other objects and advantages of this subject invention will be become apparent from the accompanying drawings and from the following description.

SUMMARY OF THE INVENTION

This invention is of a unique picture frame which employs a ring in which a picture is mounted so that front and back sides of the picture may be viewed from opposite sides of the ring. A hook attached to the ring extends substantially radially outward therefrom. A loop is attached to the ring so as to extend substantially radially outward therefrom at a point opposite to the hook. The ring, hook, and loop are in substantially the same plane. A chain of indefinite length may be created by interconnecting identical frames by placing the hook of each frame in the loop of the preceding frame. Each frame in the chain is substantially at right angles to the adjoining frames.

DISCUSSION OF THE DRAWINGS

This invention will be better understood from the following description in conjunction with the accompanying drawings, in which.

DESCRIPTION OF THE PREFERRED EMBODIMENT

Figure 1:
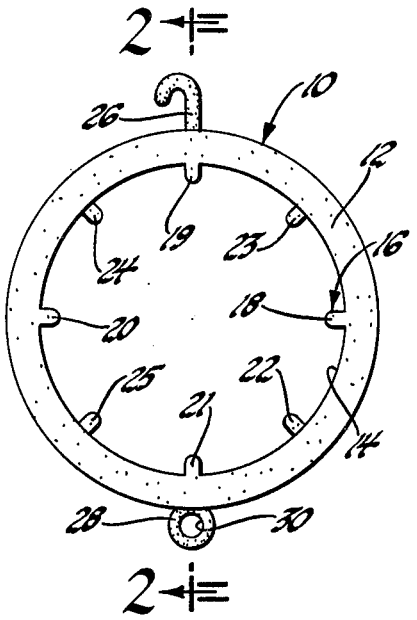
FIG. 1 is a plan view of a picture frame embodying the subject invention.

As shown in FIG. 1, a picture frame 10 is illustrated which includes a ring 12 which encircles an opening 14 in which a picture is to mounted for display.

As persons versed in the art will appreciate, a picture frame may be used for purposes of displaying objects of numerous different types. For example, and without limitation, a picture frame may be used to display photographs, paintings, art work, postcards, documents, and various achievement awards such as ribbons.

As persons versed in the art will also appreciate, objects displayed in picture frames will often be mounted behind a substantially transparent substance, such as a sheet of clear plastic or glass.

As persons versed in the art will also appreciate, objects such as the aforementioned and other objects displayed in picture frames are substantially of two dimensions as they usually have relatively small thickness.

As persons versed in the art will also appreciate, objects such as the aforementioned may also be mounted on a piece of material for purposes of adding rigidity to their structure.

As persons versed in the art will also appreciate, where such objects have only a single side, generally referred to as their front side, of interest they may be placed next to each other so their front sides face in opposite directions.

For purposes of this specification and the accompanying claims it should therefore be kept in mind that the term "picture" is to be given a very broad interpretation so as to include all objects which may be conveniently positioned in a frame for display whether or not such objects are included in those aforementioned and whether or not the picture is structurally made of a single piece or several pieces of materials and shall specifically include laminations.

A picture inserted in opening 14 in the ring 12 is securely held by retaining apparatus 16 which is eight tabs 18 through 25.

The tabs 18 through 25 extend substantially radially inward from the ring 12.

A hanger is attached to the ring 12, which in the illustrated embodiment is in the form of a hook 26 which extends substantially radially outward from the ring 12. A connecting member in the form of a loop 28 is attached to the ring 12 at a point substantially opposite the hook 26 and extends substantially radially outward from the ring 12. The loop 28 in the preferred embodiment is an eyelet having a hole 30 which has a diameter larger than the diameter of the hook 26.

Figure 2:
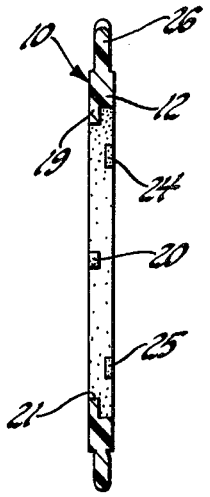
FIG. 2 is a section view taken along the line 2—2 shown in FIG. 1.

In the illustrated embodiment the hook 26, loop 28, the ring 12, and the picture within the ring 12, lie in substantially one plane which is most apparent in FIG. 2, which is a cross-section of the frame 10 illustrated in FIG. 1.

As shown in FIG. 2, the cross-section of the hook 26 and the loop 28 in the preferred embodiment is that they are each round and made as a single piece integral with the ring 12. It is also to be noted that the tabs 18 through 25 in the preferred embodiment are also molded integral with the ring 12. As persons versed in the art will appreciate, the frame 10 does not have to be manufactured from a single piece of material as each of its component parts may be separately made and attached so as to operate substantially similar to the illustrated embodiment.

It will also be apparent to practitioners that the frame 10 could be made with the hook 26 and the loop 28 rotated 90° about an axis common to both of them and still provide for identical function. If either the hook 26 or the loop 28 were rotated 90° without changing the orientation of the other of them the chain hereinafter described would not have each frame oriented at right angles to adjoining frames when the chain hereinafter described is formed.

Figure 3:
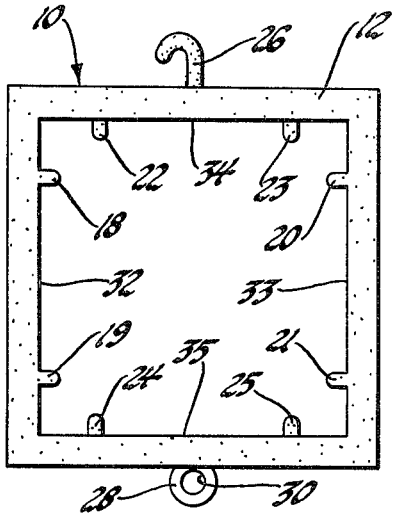
FIG. 3 is a plan view of an alternative embodiment of the invention.

As shown in FIG. 3, the ring 12 may be in the form of a square. As persons versed in the art will appreciate, the ring 12 may be of an indefinite variety of configurations without departing from the spirit of this invention.

In the embodiment illustrated in FIG. 1 the retaining tabs 18 through 25 are positioned on the ring 12, which forms a continuous side wall around the picture so as to have the tabs 18 through 21 in front of the picture and the tabs 22 through 25 at the back, or rear, of the picture. In the illustrated embodiment the front tabs 18 through 21 are equally spaced in FIG. 1 and the rear tabs 22 through 25 are equally spaced in FIG. 1 and the tabs 18 through 25 are alternated so the front tabs are equally spaced between the rear tabs.

As shown in FIG. 3, it is not essential that the tabs 18 through 25 be alternated or equally spaced as in some instances and to hold various pictures it may be preferable otherwise. In FIG. 3 the front tabs 18 through 21 are on two opposite sides 32 and 33 while the rear tabs 22 through 25 are on the other opposing sides 34 and 35.

As persons versed in the art will appreciate, the configuration of the tabs 18 through 25 may be varied substantially without deviation from the subject invention. For example, if the tabs 18 through 25 are made with a rigid material integral with the ring 12 it would be extremely difficult to insert a rigid picture in the frame 10 so as to position it with the front tabs 18 through 21 adjacent to the front of the picture and the rear tabs 22 through 25 adjacent the rear of the picture. Therefore for purposes of displaying relatively solid pictures it may be preferable to form the tabs 18 through 25 out of a deformable material so they may be bent out of the way to accomodate insertion of a picture in the frame 10. One way of making deformable tabs 18 through 25 would be to make the entire frame 10 out of a suitable injection molded plastic which when made in the thickness of the tabs 18 through 25 is deformable but when made in the thickness of the other elements of this frame 10 is substantially rigid. Another way of providing deformable tabs 18–25 would be to make them of metal flanges placed in a mold prior filling the mold with plastic so that the metal flanges would be embedded in the plastic.

Figure 4:
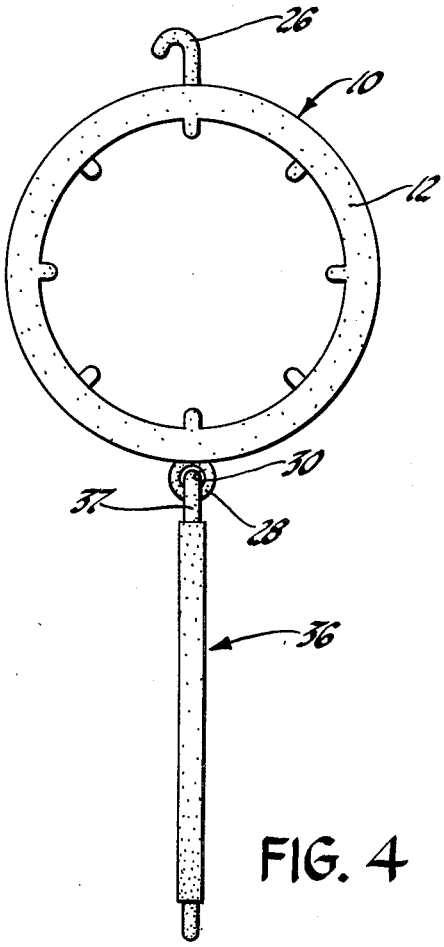
FIG. 4 is a plan view of two interconnected picture frames of the type illustrated in FIG. 1.

As shown in FIG. 4, the frame 10 may be interconnected with a substantially identical frame 36 by inserting the hook 37 in a hole 30 of the loop 28. As shown in FIG. 4, interconnection in this manner results in each frame being positioned so the plane which substantially describes the frame is substantially at right angle to the plane describing each adjoining frame.

The interconnection created when the frame 10 is joined with indentical frames by which each frame is at right angles to adjoining frames is important as the chain formed by interconnection between the frames results in displaying both front and rear sides of the pictures. Therefore when the frame 10 is hung from a support by hook 26 and additional frames are added to form a chain persons in all parts of the room are able to see either front or reverse sides of the various pictures. Thus, for example, where the picture in each frame includes two photographs with their back to each other persons in all parts of the room are able to see some of the photographs.

Figure 5:
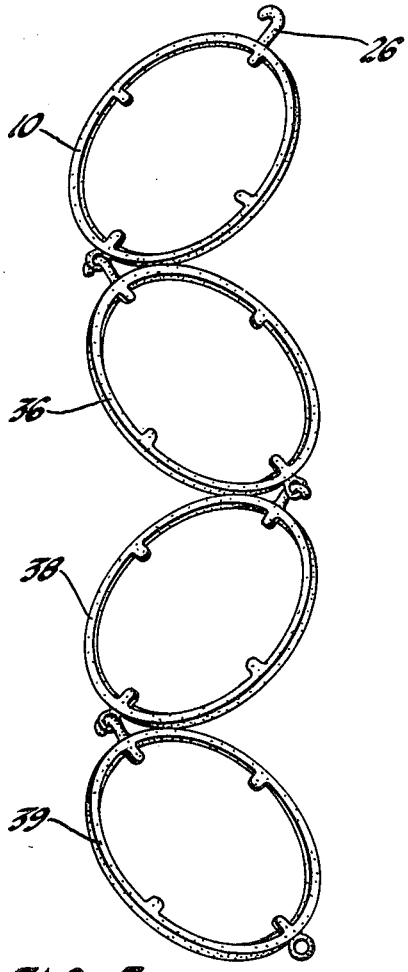
FIG. 5 is a plan view of interconnected picture frames of the type shown in FIG. 1.

As shown in FIG. 5, a chain of picture frames may be created by adding additional frames 38 and 39, each frame being connected to the preceding frame by placing its hook in the loop of the preceding frame.

The orientation of the frames in FIG. 5 illustrates how the respective pictures would be easily viewable from a variety of directions.

FIG. 5 also illustrates how the chain created by a succession of frames which are each identical and made in accordance with this invention is flexible. Therefore in the event the chain is bumped the pictures and respective frames are not damaged. However, persons versed in the art will appreciate that when the chain of frames as illustrated in FIG. 5 is hung from a single point by connecting the hook 26 to a suitable support the force of gravity will extend the chain so each frame is at right angles to the adjoining frame in the manner illustrated in FIG. 4.

Persons versed in the art will appreciate that various modifications of the apparatus illustrated may be made without departing from the spirit of the invention. For example, the picture retaining mechanism in place of the tabs 18 through 25 could be in the form of an annular groove and on the opening 14 of the ring 12. In the alternative, a combination of annular groove and tabs could be provided to retain the picture. For example, if a groove were provided in the bottom half of the ring 12 pictures may be satisfactorily held in the ring 12 by a single tab at the top of the ring 12 on each side of the picture, one tab being the tab 19 and the other tab directly behind tab 19 and spaced from the tab 19 by a distance slightly greater than the picture so as to prevent insertion of the picture between the tabs and then setting the picture into the groove. Persons versed in the art will appreciate therefore that a groove would function in the same way as a series of tabs and therefore as used in this specification and appended claims the term "tab" is to be given a broad definition which would include the sides of the groove or other functionally similar apparatus.

As persons versed in the art will appreciate, connecting the hook 26 in the loop 28 in the same manner between each pair of frames in a chain results in a spiral display with the front of each frame 10 indexed 90 degrees from the front of each successive frame. Thus the front of four successive frames face in four different directions when so connected. However, it may be desired to emphasize the spiral nature of such interconnection to direct the front of the frames in more directions.

As persons versed in the art will appreciate, rotation of either the hook 26 or the loop 28 by 45 degrees around a centerline common to the hook 26 and loop 28 from that illustrated will result in each frame 10 being positioned at a 45 degree angle from the frames to which it is connected. For example, by connecting a chain of identical frames in which each frame has the hook 26 rotated by 45 degrees from the position illustrated each frame will hang from the preceding frame so as to be indexed by 45 degrees from the preceding frame. This would result in the fronts of the pictures displayed in the frames forming a spiral with the fronts of eight successive frames facing in eight different directions.

Therefore as used in the claims herein the term "substantially at right angles" in describing the relative positions of successive frames shall be construed to include significant angles other than 90 degrees which result in a chain of said frames forming a spiral display of the type described herein.

While the illustrated embodiment is the preferred embodiment persons versed in the art will appreciate that various other configurations and apparatus may be used in the subject interconnectable picture frames without departing from the spirit of this invention.

What is claimed is:

1. A picture frame for simultaneous display of front and rear sides of a picture comprising, in combination, a ring for substantially encircling the edge of said picture between said front and rear sides, said ring being defined by a plane; a loop radially positioned on and secured to said ring so as to extend radially outward from said ring and said picture edge in a first direction; a hook positioned on and secured to said ring so as to extend radially outward from said ring and picture edge in a second direction opposite said first direction, said hook being of a size that may be inserted in said loop, said hook and said loop being angularly disposed so that when said hook of said picture frame is inserted into said loop of an identical picture frame the planes which define said picture frames are at a predetermined angle to each other and are not parallel; and a set of picture retaining tabs inside said ring approximate said pictures so as to retain said picture in said ring.

2. A picture frame for simultaneous display of front and rear sides of a picture comprising, in combination, a ring in which said picture is inserted for simultaneous viewing of both said picture front and rear sides, said ring and said picture inserted therein being defined by a plane, a first connection member secured to and extending radially outward from said ring and substantially in said plane, a second connection member secured to and extending radially outward from said ring substantially in said plane, said first and second connection members extending in opposite directions from said ring, said first connection member being connectable to the second connection member of an identical picture frame so as to permit forming a chain of identical picture frames by connecting said connection members of each successive picture frame in said chain to connection members of each adjoining picture frames, said first and second connection members of each picture frame being oriented in the plane of said picture frames so that the planes of each picture frame in a chain of identical picture frames is not parallel to the plane of an adjoining picture frame, and picture retaining tabs secured to said ring to retain said picture in said ring.

3. A picture frame for display of pictures comprising, in combination, a ring defined by a plane and front and rear sides, a picture being inserted in said ring, picture retaining tabs secured to said ring proximate said picture for retaining said picture therein, a loop secured to said ring so as to extend radially outward therefrom, a hook secured to said ring so as to extend radially outward therefrom for insertion of said hook into a loop of a picture frame identical to said picture frame, said loop and said hook being positioned substantially on opposite sides of said ring, said loop and said hook being positioned in said plane so that when a hook of said picture frame is inserted into a loop of an identical picture frame so as to connect said picture frames together the planes defining the rings of said picture frames are at right angles to each other.

4. Apparatus for simultaneous display of front and back sides of a picture comprising, in combination, a first picture frame comprised of a ring in which a picture may be inserted, picture retaining tabs secured to said ring proximate said picture for retaining said picture in said ring, said ring being defined by a plane, a first connection member secured to and extending radially outward from said ring substantially in a line in said plane, a second connection member secured to and extending radially outward from said ring substantially on a line in said plane, said first and second connection members extending in opposite directions from said ring substantially on the same line, said first picture frame first connection member being connectable to a second connection member of a second picture frame which is identical to said first picture frame and said first and second connection members being oriented on said line at an angle to said plane whereby a hanging chain of said picture frames may be formed by connecting said one picture frame to said second picture frame and connecting additional identical picture frames to said first and second picture frame so that when one of said picture frames at one end of said chain is supported the other of said picture frames in said chain are hung from said supported picture frame and the plane of each successive picture frame ring is not parallel to the plane of an adjoining picture frame ring.

* * * * *